United States Patent [19]

Maringer

[11] 4,399,611

[45] Aug. 23, 1983

[54] ARTICLE OF DECORATIVE METAL MANUFACTURE

[76] Inventor: Thomas E. Maringer, 2306 S. Powell St., Springdale, Ark. 72764

[21] Appl. No.: 205,426

[22] Filed: Nov. 10, 1980

[51] Int. Cl.[3] ..... B26B 9/00

[52] U.S. Cl. ..... 30/350; 76/104 R; 228/162; 228/190; 228/263.13; 428/678; 428/685; 428/687

[58] Field of Search ..... 228/160, 162, 190, 158, 228/263 A, 263 D; 29/160.6; 428/635, 678, 685, 687, 679, 680; 30/350; 76/104 R

[56] References Cited

U.S. PATENT DOCUMENTS 3,441,996 5/1969 Boothe ..... 228/190 X
3,465,419 9/1969 Keenan et al. ..... 228/160
3,862,484 1/1975 Chivinsky ..... 228/158
4,148,973 4/1979 Sexton et al. ..... 228/263 D X
4,302,515 11/1981 DeCristofaro et al. .... 228/263 A X

FOREIGN PATENT DOCUMENTS 550382 11/1934 Fed. Rep. of Germany ..... 30/350

*Primary Examiner*—Kenneth J. Ramsey
*Attorney, Agent, or Firm*—Robert B. Watkins

[57] ABSTRACT

A decorative metal article of manufacture and the process of making it including assembling alternate layers of steel and brazing alloys, heating them while in intimate contact, then removing portions of the layers leaving elevated portions adjacent to depressed portions, and then subjecting the structure to compression to compress the elevated portions to the level of the depressed portion, and finally polishing the article.

11 Claims, 5 Drawing Figures

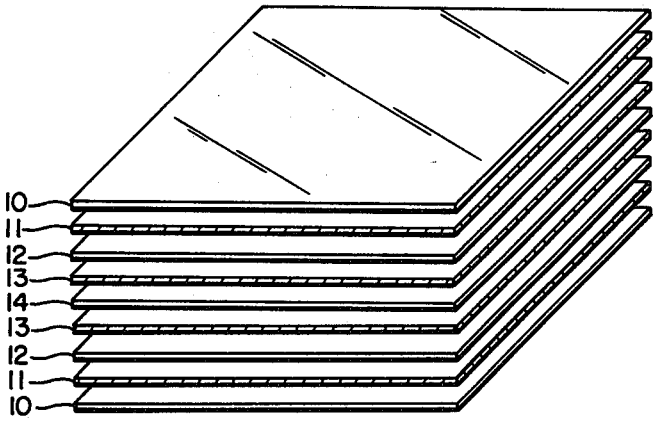
FIG 1
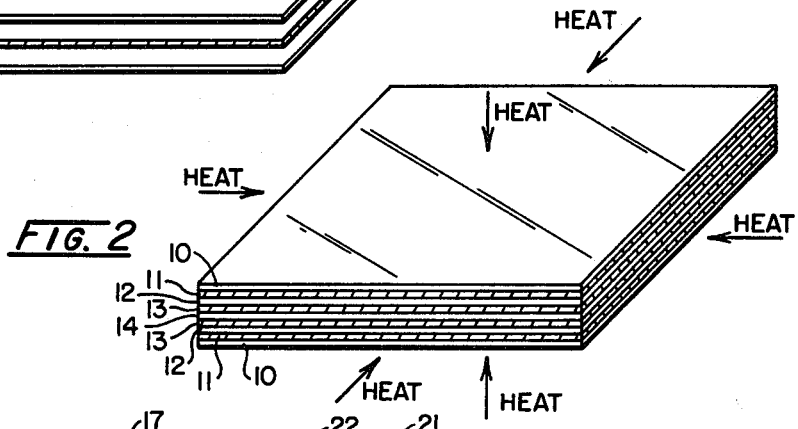
FIG. 2
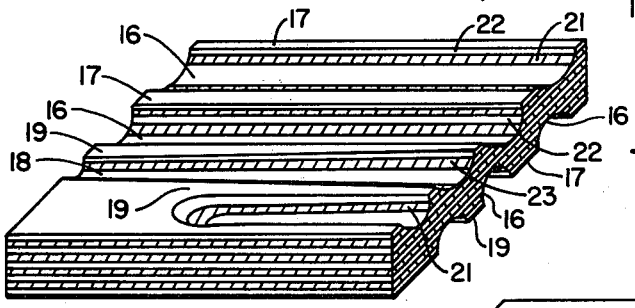
FIG. 3
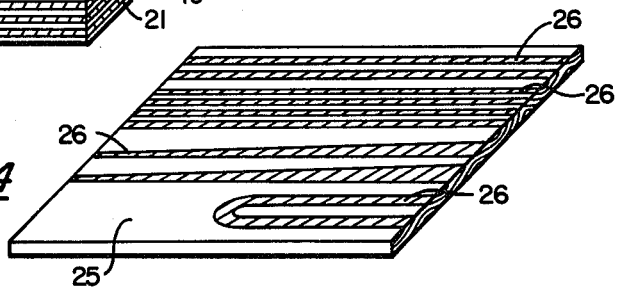
FIG. 4
FIG. 5
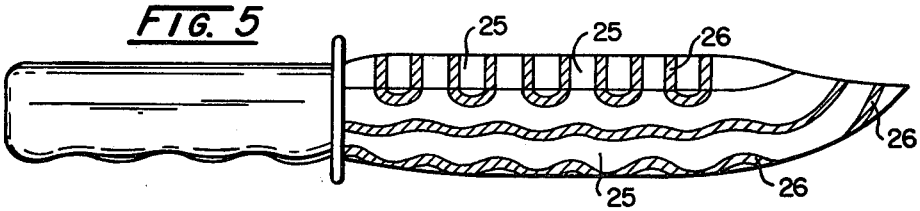

ARTICLE OF DECORATIVE METAL MANUFACTURE

SUMMARY OF THE INVENTION

This invention relates generally to decorative metal articles of manufacture and a method of making them. More particularly, it relates to those metal articles having on their surface a variegated pattern of shiny highlights and subdued lustre which are the visible evidence of variations in the surface of the material caused by differences in the material itself across the metal surface. These metal surface differences are created by the composite nature of the material resulting from the way in which it is made.

Briefly, and in summary, this invention is an article of manufacture and the process of making it comprising: assembling between surface layers a laminated structure of alternating internal layers of steel and a brazing alloy, the brazing alloy having a composition comprising nickel and at least one of the groups consisting of chromium, boron, silicon and iron; followed by heating the structure for a suitable time, normally about 30 minutes, at a temperature only slightly higher than the melting temperature of the brazing alloy; and then removing portions of at least one surface layer of the structure to a depth which penetrates at least one brazing alloy layer, leaving elevated portions adjacent to depressed portions; and then subjecting the structure to working conditions which compress the elevated portions to the level of the depressed portions to produce a surface of decorative appearance. In a preferred embodiment the brazing alloy is in foil form when placed between the steel layers.

Although the articles manufactured according to this invention may be of various sizes, shapes and uses, an important item is the blade element of a knife or sword. Examples of other items are jewelry, bowls, dishes, trays, picture frames, and belt buckles. Also, items of fancy table cutlery may be made, either the entire piece or just the handle.

Decorative metal articles are made in a great variety of ways and the history of this art goes back into the days of antiquity. The decoration may result from variation being introduced on the surface by means of externally applied films such as paints and lacquers or the decoration may be created by treatment of the metal surface itself. Various chemical methods are employed. In those techniques where the surface of the material is treated, the final appearance depends to a degree of the kind of material at the surface.

Some materials such as wood have a grain structure of fiber orientation which lends itself well to surface treatment which brings out variations in the structure creating a variety of colors and lines, degrees of lustre, which when viewed, pleases the aesthetic sense and are considered decorative. Metals, on the other hand, are essentially fiberless and homogeneous, thus the creation of variations in the surface is more difficult to achieve.

One way of achieving a variegated surface appearance on metals is to create a surface which cuts across various layers of a composite layered material structure.

For many years a large variety of ways have been used to create decorative metal objects from composite layered metal structures. U.S. Pat. No. 3,465,419 is a typical example of a material structure and a process of making it which is useful for creating decorative articles of metal manufacture. As revealed in the patent the soldering process has been applied to non-ferrous materials and composites.

Numerous problems exist which have not been satisfactorily solved prior to the present invention. One such problem is the great amount of time and work required in creating effective bonds between the various layers of the laminated structural material. Two well known techniques are silver soldering and forge welding as stated in the above mentioned patent.

In the silver soldering technique, the process is expensive due to the cost of the silver materials. A large measure of skill and process control is necessary to get an effective bond between the layers and alloying elements are necessary in order to raise the melting point of the solder. Otherwise the finished article could not be used at an elevated temperature or the bond would melt.

In the forge welding techniques, high pressures and high temperatures are required to cause a fusion of the surfaces between the layers to produce a homogeneous surface connection. Forging also has disadvantages in that it is a process that can only be grossly adjusted in comparison to other techniques requiring less force and pressure.

However, the desirable features of an attractive appearance, and the achievement of a composite physical characteristics in the final materials, are such that the practice of making decorative metal articles has continued.

In some articles where it is desirable that the article have exceptional strength in comparison to its thickness of mass, such as knives, swords, and cutlery of all kinds, blending of several materials into a laminated composite makes possible an article that combines the physical characteristics of materials in the final structure. For instance, in making knives and swords it is desirable to have the ductility of mild steel as well as the hardness and strength of alloy steels such as stainless steels. This has been accomplished by laminating layers of various metals by various techniques including those described above.

After the materials are laminated into a composite structure and they are worked and ground to a knife, sword, or other cutting edge the edges of the various layers are exposed in a variegated pattern of shiny highlights and subdued lustre which has come to be considered decorative and pleasing to the eye.

An example of such knives and swords is the "Damascus" blade which gets its name from that period and place in history when the art of making such blades was first achieved. Historians are not sure of the exact techniques that were used to create the Damascus blades but it is thought that they were usually made by working, selective melting, and etching a single piece ("coke") of steel. The etching process acted differently on the difference metals creating different colors and variations in the surface appearance to produce the characteristic variegated surface of a Damascus blade.

A discussion of the art of making Damascus blades will be found in "A History of Metallography" published by University of Chicago Press in 1960.

Welded "Damascus" swords were made in Europe in the eighteenth century by forge welding laminated layers of iron and steel (page 30 of the above reference).

Today, and as time goes on, the manufacture of Damascus blade knives and articles of manufacture is a sought after technique. The process for the manufacture of a present day duplicate of the Damascus blade has, until the present invention, escaped a satisfactory solution.

In accordance with the present invention, a process has been discovered by which decorate metal articles can be manufactured by simple, controllable processes with readily available materials to produce articles having a decorative appearance and very closely resembling the appearance of the ancient Damascus blade.

Accordingly, it is an object of this invention to product articles of manufacture by the process of this invention which are attractive in appearance, strong and serviceable in use, relatively inexpensive and affordable by large numbers of the populus.

Other objectives and features of the invention will be apparent from the following drawings and detailed description of the invention.

DESCRIPTION OF THE DRAWINGS

FIG. 1 is a perspective view of the organized materials used in the process of this invention.

FIG. 2 is a perspective view of the assembled materials at an earlier stage in the manufacture of the articles of this invention.

FIG. 3 is a perspective view of the material structure of this invention at a later stage in the process of manufacture of an article of this invention.

FIG. 4 is a perspective view of an article of manufacture made according to the process of this invention at further another stage in the process.

FIG. 5 is a perspective view of a finished article of manufacture made according to the process of this invention.

DETAILED DESCRIPTION OF THE INVENTION

In an embodiment of the process of this invention, referring to FIG. 1, a plurality of sheets of material 10, 11, 12, 13 and 14, are assembled one above the other in parallel planer laminar fashion. By way of example, the first or outer surface layer 10 is a stainless steel sheet. The second internal layer 11 is a brazing alloy foil. The third internal layer 12 is a stainless steel sheet, the fourth internal layer 13 is a brazing alloy foil, and the fifth internal, layer 14 is a stainless steel sheet.

In the next step in the process, referring to FIG. 2, the laminated sheets 10, 11, 12, 13 and 14 are heated to a temperature slightly above the melting point of the brazing alloy foil. In this step the laminated sheets are lightly pressed into intimate contact and the temperature is maintained at the elevated point long enough for the entire structure to come up to the temperature throughout. The pressure applied is not enough to deform or work the steel materials, but only enough to cause all the materials surface contact.

A typical stainless steel material for use as layers 10, 12, 13 and 14, is a 302. A typical brazing alloy foil is a Ni-3.1 B-4.5 Si-3.0 Fe-7.0 Cr.

Using this typical brazing alloy foil, the temperature of the laminar structure is raised to about 2000° F. (1093° C.) throughout, for about one half hour. The time may be longer than necessary for the temperature to reach the melting point of the alloy, but it cannot be less for successful practice of the invention.

Accordingly, when the temperature is the brazing alloy melting temperature throughout, the stainless sheets are brazed and alloyed to one another with the layer of brazing alloy continuous throughout between each stainless steel sheet. Because the brazing alloy foil is a uniform thickness, the thickness of the alloy layer between the stainless steel sheets remains constant throughout.

In the preferred practice of the invention brazing alloy foil is used because of the ease in assembling the composite with a precisely controlled thickness of brazing alloy. However, the alloy could be inserted in powder form if care is precisely exercised to control the thickness of the alloy layer.

In the next step of the process, portions of the materials are ground away, or otherwise excavated, to a depth that penetrates at least one of the alloy layers, as shown in FIG. 3. The excavation may be carried out in a regular pattern creating uniform depressions 16 and leaving uniform shaped elevated areas 17, or the excavations may be irregular and random creating an irregular pattern of depressions 18 and leaving an irregular pattern of elevated portions 19. Because the ground depressions 16 and 18 penetrate at least one brazing alloy foil internal layers 11 and 13, an edge 21 is exposed which is a different color and appearance from an edge 22 of the stainless steel layers 10 and 12 on opposite sides. Also, because the depressions 16 are regular and uniform, the edges 22 are straight and uniform. However, because the depressions 18 are irregular and varied, the edges 23 exposed in the depressions 18 and 19 are irregular in shape and varied in contour.

The excavations may be carried out on both the bottom and the top sides of the composite materials, to provide a decorative finish on both sides.

In the next step the structure is subjected to working operations that compress the elevated portions to the level of the depressed portions, as shown in FIG. 4. At this state the surface 25 reveals lines 26 and variations in color resulting from the different materials that are exposed in the surface.

The working operations may be carried out either hot or cold and may be either conventional rolling or hammering processes. If a hot or cold rolling technique is used upon a portion of the surface 25 that has uniform lines and shapes, the material structure can be worked without distorting the uniformity of the lines 16. On the other hand, if the working operation is a random hammering technique, the lines 16 will be distorted from their previous shape.

In this process the shape and contour of the lines in the finished product are under control of the decisions and skills of those who operate the process.

If in the process of removing portions of the material, as shown in FIG. 3, a pre-determined pattern is developed, the pattern may be maintained by the type of working operations which are used in the latter step of the process. However, the uniformity of lines in the final product depends upon refinement and resolution of the lines at the interface between the brazing alloy foil layers and the steel layers. Because of the controlled thickness of the brazing alloy layer, especially when foil is used, and the ease with which it is alloyed to the adjacent layers of stainless steel, the lines are exceedingly fine and uniform in the material structure at the stage when it is ready to be finally shaped into an element of an article of manufacture. Also, the lines remain fine and uniform in the structure when it is finally finished and polished as the element, such as a knife blade shown in FIG. 5. The lines are either straight or contoured according to the decision of the manufacturer.

The line work and the decorative appearance can be made very near the same as a Damascus blade.

It has been found that in the final working of the surface no etching is needed and the desired appearance can be achieved by cold work and polishing alone.

In the manufacture of an article such as a knife blade it has been found that an exceptionally fine knife blade having the appearance of a Damascus blade, can be manufactured from a laminated structure material beginning with a layer of stainless steel 0.005 inches thick (0.013 mm), next to a layer of brazing alloy foil 0.002 inches thick (0.005 mm), next to a layer of mild steel 0.005 inches thick (0.013 mm), next to a layer of brazing alloy foil 0.002 inches thick (0.005 mm), next to a layer of stainless steel 0.005 inches thick (0.013 mm), followed by processing through a heating step at 2000° F. (1093° C.) for two hours, then grinding in random fashion followed by hammering, and finishing into a knife blade by grinding and polishing produces an exceptionally fine blade.

It has been found that cleaning the contact surfaces between the steel and brazing alloy foil with ethyenol before assembling them into alternate layers is very helpful in obtaining a structure without voids or imperfections along the lines of layer distinction in the final product.

It is believed that various grades of stainless steel including those having a composition of 302, 304 and 440C would be useful in the invention process. Thickness in the range of 0.002 to 0.010 inches are considered to be the best range.

Various brazing alloy foils could be used, including those in the following Table "A" which are produced by Wall Colmonoy Corp. of Detroit, Mich., under the name "Nicrobraze". Foil thicknesses in the range of 0.001 to 0.003 inches are considered to be the best range.

TABLE "A"

| NICRO-BRAZ GRADE | NOMINAL COMPOSITION (BY WEIGHT PERCENT) | | | | | | | APPROX. BRAZING TEMP. | |
|---|---|---|---|---|---|---|---|---|---|
| | Cr | Fe | Si | C (max) | B | P | Ni | °F. | °C. |
| LC | 15.0 | 3.0 | 4.5 | 0.06 | 3.0 | — | Bal. | 2150 | 1175 |
| LM | 7.0 | 3.0 | 4.5 | 0.06 | 3.1 | — | Bal. | 1900 | 1040 |
| 130 | — | — | 4.5 | 0.06 | 3.1 | — | Bal. | 1900 | 1040 |
| 10 | — | — | — | 0.10 | — | 11.0 | Bal. | 1800 | 980 |
| 135 | — | — | 3.5 | 0.06 | 1.9 | — | Bal. | 2050 | 1120 |

A particularly important feature of this invention is the construction of the material structure having brazing alloys containing nickel and at least one of the groups consisting of chromium, boron, silicon and iron. It has been found that these materials when used in controlled quantities provide an essential alloying interface which is strong as well as decorative in appearance. The use of the material in controlled thickness foils enhances the refinement of the lines and the appearance on the decorative surface of the material.

It is herein understood that although the present invention has been specifically disclosed with the preferred embodiments and examples, modification and variations of the concepts herein disclosed may be resorted to by those skilled in the art. Such modifications and variations are considered to be within the scope of the invention and the appended claims.

What is claimed is:

1. A method of manufacturing a decorative metal article of cutlery having a cutting blade of exceptional alloyed strength comprising:

a. assembling between surface layers a laminated structure of alternating internal layers of steel and brazing alloy in the form of a foil of uniform thickness, the brazing alloy having a composition comprising nickel and at least one of the group consisting of chromium, boron, silicon and iron;

b. heating the structure throughout while the layers are in intimate contact to about 2000° F., a temperature higher than the melting temperature of the brazing alloy, for at least about one half hour;

c. removing portions of at least one surface layer of the structure to a depth which penetrates at the least one brazing alloy layer, leaving elevated portions adjacent to depressed portions;

d. subjecting the structure to working operations which compress the elevated portions to the level of the depressed portions, and shape the structure into a cutlery blade;

e. and polishing the blade to produce a surface of variegated decorative appearance.

2. A method of manufacturing a decorative metal article according to claim 1 wherein the steel and brazing alloy foil are cleaned with ethyenol before assembly according to step (a).

3. A method of manufacturing a decorative metal article according to claim 1 wherein the layers of steel are between 0.002 and 0.010 inches thick.

4. A method of manufacturing a decorative metal article according to claim 1 wherein the layers of steel are about 0.005 inches thick.

5. A method of manufacturing a decorative metal article according to claim 1 wherein the brazing alloy foil is about 0.001 to 0.003 inches thick.

6. A method of manufacturing a decorative metal article according to claim 1 wherein the layers of steel are about 0.005 inches thick and the brazing alloy foil is about 0.002 inches thick.

7. A decorative article of cutlery having a blade containing at least one element made by the process according to claim 1.

8. A decorative article of cutlery having a blade containing at least one element made by the process according to claim 3.

9. A decorative article of cutlery having a blade containing at least one element made by the process according to claim 4.

10. A decorative article of cutlery having a blade containing at least one element made by the process according to claim 5.

11. A decorative article of cutlery having a blade containing at least one element made by the process according to claim 6.

* * * * *